US009764874B2

(12) United States Patent
Boyer

(10) Patent No.: US 9,764,874 B2
(45) **Date of Patent: *Sep. 19, 2017**

(54) SLIDE OPENING DISPLAY AND MAIL PACKAGE

(71) Applicant: MCD, Inc., Madison, WI (US)

(72) Inventor: David C. Boyer, Madison, WI (US)

(73) Assignee: MCD, Inc., Madison, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/985,548

(22) Filed: Dec. 31, 2015

(65) Prior Publication Data

US 2016/0185481 A1 Jun. 30, 2016

Related U.S. Application Data

(63) Continuation of application No. 14/085,479, filed on Nov. 20, 2013, now Pat. No. 9,227,775.

(60) Provisional application No. 61/791,950, filed on Feb. 7, 2013.

(51) Int. Cl.
*B65D 5/38* (2006.01)
*B65D 85/00* (2006.01)

(52) U.S. Cl.
CPC ..... *B65D 5/38* (2013.01); *B65D 85/00* (2013.01)

(58) Field of Classification Search
CPC ..... B65D 5/38; B65D 85/00
USPC ..... 206/758, 468, 1.5, 308.1
See application file for complete search history.

(56) References Cited

U.S. PATENT DOCUMENTS 5,421,452 A * 6/1995 Hybiske ..... B65D 85/548 206/308.1
6,032,795 A * 3/2000 Ehrlund ..... B65D 5/38 206/232
7,090,079 B2 * 8/2006 Ehrlund ..... B65D 83/0463 206/1.5
7,389,875 B2 * 6/2008 Sandberg ..... B65D 5/38 206/1.5
8,499,936 B2 * 8/2013 Albrecht ..... B65D 83/0463 206/528
2003/0000854 A1 * 1/2003 Jang ..... G11B 33/0422 206/308.1
2006/0042968 A1 * 3/2006 Goldberg ..... G11B 33/0422 206/232
2007/0251843 A1 * 11/2007 Wynalda, Jr. ..... G11B 33/0411 206/308.1
2009/0288968 A1 * 11/2009 Wynalda, Jr. ..... G11B 33/0422 206/308.1
2009/0301924 A1 * 12/2009 Rondeau ..... B65D 83/0463 206/531

* cited by examiner

*Primary Examiner* — Steven A. Reynolds
(74) *Attorney, Agent, or Firm* — Smith Law Office; Jeffry W. Smith

(57) ABSTRACT

An economical package including an inner sliding piece assembled inside of one or more outer sleeves, where the inner sliding piece may contain a gift card, loyalty card, product, or promotional messages, and the card, product or messages can be revealed by pulling the inner sliding piece at least partially out of the outer sleeve. The package assembly can provide differentiation, protection, consumer information, and an ability to reuse the package for presentation of the card or information.

19 Claims, 16 Drawing Sheets

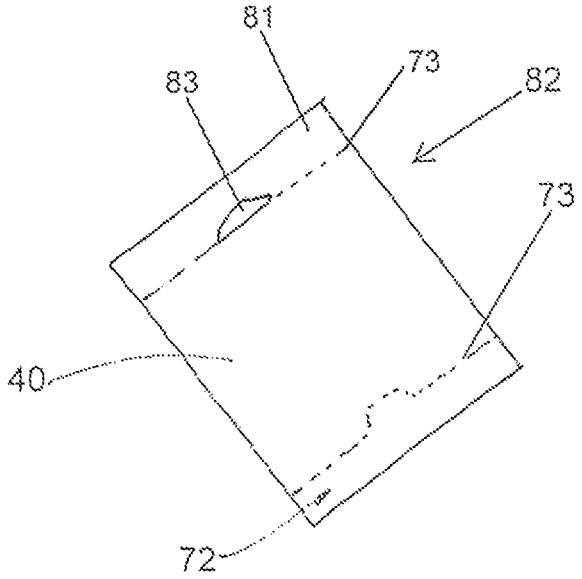
Fig. 7a
Fig. 7b
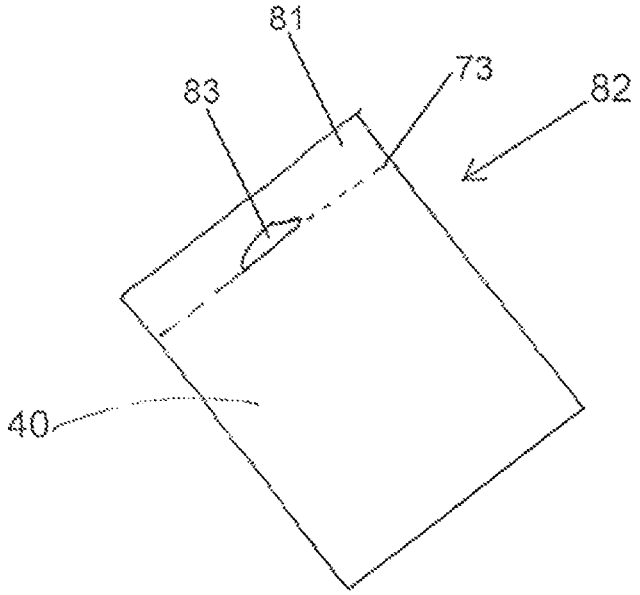

51
46
74
22
40
51
46
24
22
84

Fig. 13
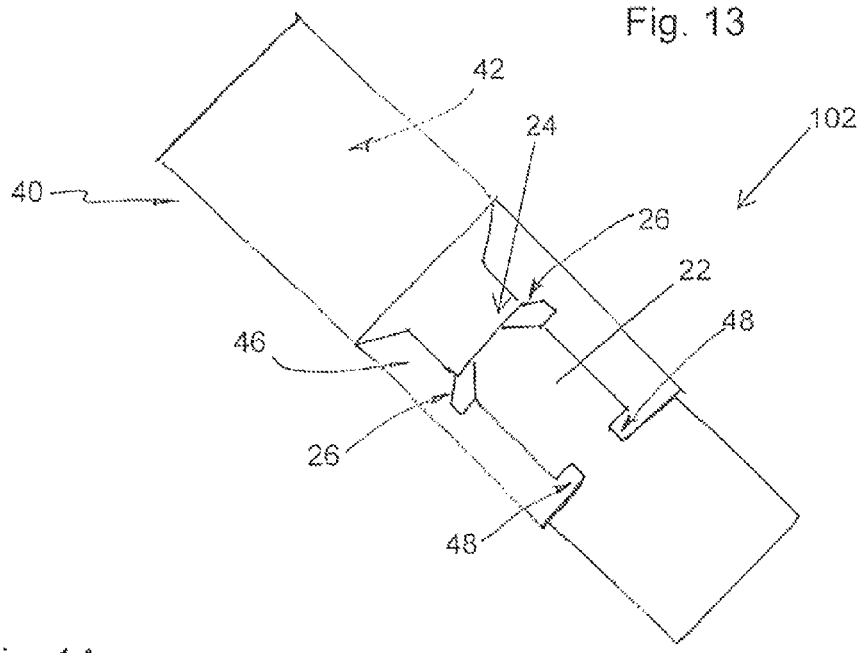
Fig. 14a
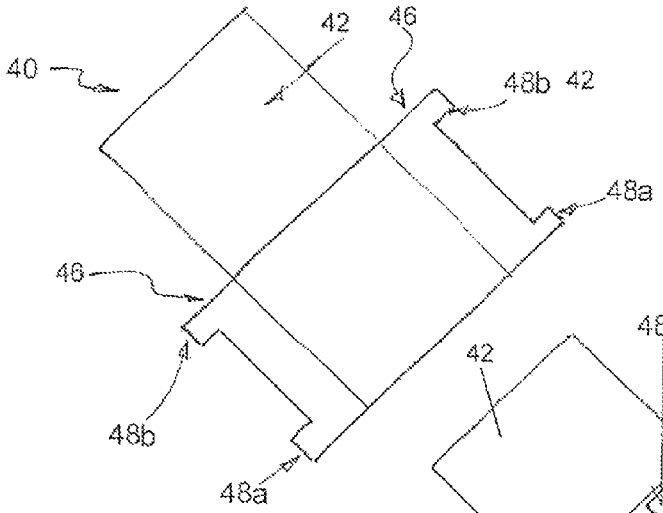
Fig. 14b
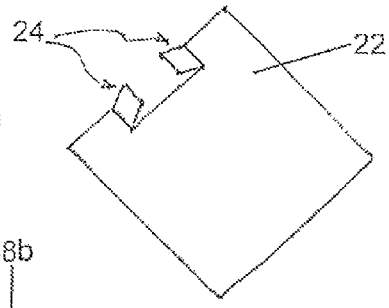
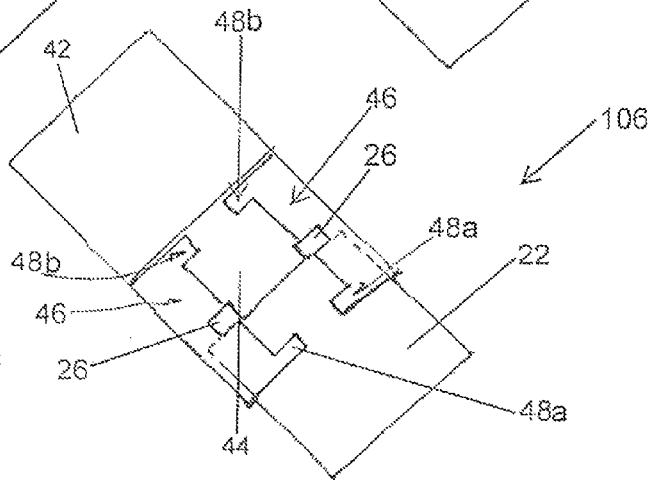
Fig. 14c

Fig. 19a
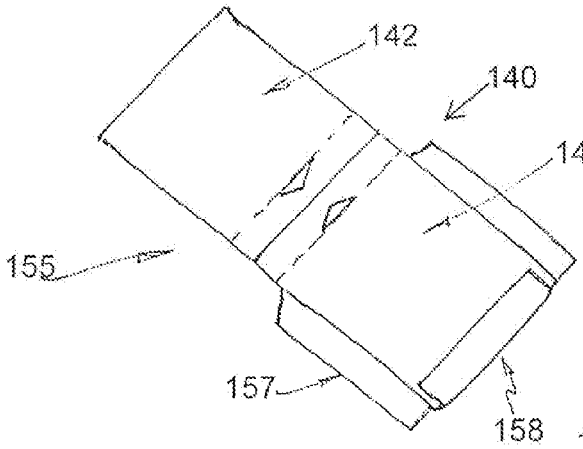
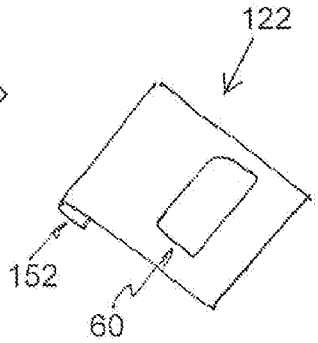
Fig. 19b
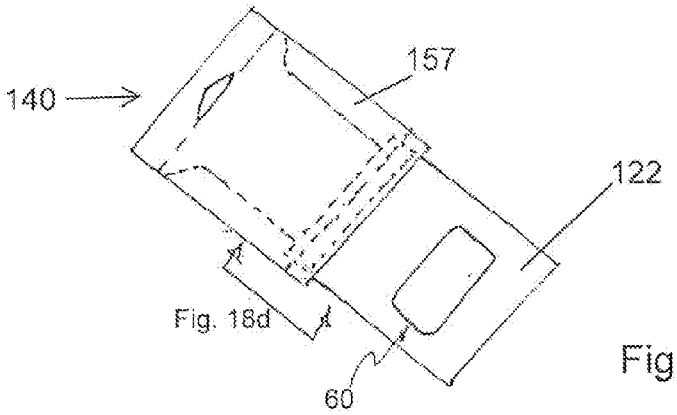
Fig. 19c
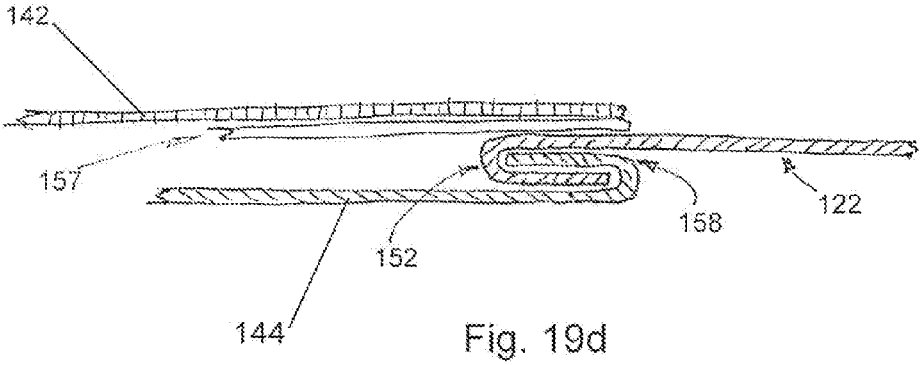
Fig. 19d

SLIDE OPENING DISPLAY AND MAIL PACKAGE

This application is a continuation of U.S. application Ser. No. 14/085,479, filed Nov. 20, 2013, which claims the benefit of U.S. Provisional Application No. 61/761,950, filed Feb. 7, 2013, each of which is incorporated by reference in their entireties.

FIELD OF THE INVENTION

The present invention relates generally to packaging for retail display or direct mailing of gift cards, loyalty cards, credit cards, other promotional or valuable products, or information, and more particularly to packaging having inner and outer components that slide relative to one another and are locked together using tabs and stops that can be assembled in an automated process.

BACKGROUND OF THE INVENTION

Gift cards, loyalty cards, credit cards and other relatively flat products such as sachets of liquids, keys, coins, etc., are often attached to carrier cards or placed inside of sleeves or folded cards to allow for retail display or mailing of the products. These carrier cards, with or without attached items, are used either for promotional offers or information, or for retail sales of products.

In addition to providing for the display or mailing of products, these retail displays or mail cards protect and secure the products, educate the consumer, and visually differentiate from other consumer choices. The most favored packages in this field are those that can be differentiated, provide a useful function for protection and security, can be reused as a gift presentation, serve as an interactive method of advertising and informing, and are of a relatively low cost to manufacture.

There exist packages having a moving or sliding piece in a sleeve to provide for protection and reuse of the package, however the prior designs are difficult to produce, fill and assemble, and are too expensive for many applications. The prior products have an outer sleeve produced with an internal stop panel folded up from the bottom of the sleeve and extending all the way across the inside of the outer sleeve. An inner sliding piece is produced with an extension of the sliding piece called a stop flap that is folded under the inner sliding piece and directed downward.

In assembly, the outer sleeve is folded to have front and back panels that are secured to each other along the sides with glue on glue flaps to form a pocket with an open bottom edge. The inner sliding piece then has a gift card glued to it and the stop flap is folded over the back of the insert, and then inserted into the outer sleeve, usually by hand. The downwardly folded stop flap at the top of the inner sliding piece is intended to "hook" or interlock with the upwardly folded stop panel at the bottom of the outer sleeve when the inner sliding piece is pulled part way out of the outer sleeve. This design, however, is unreliable because the downwardly folded stop flap and upwardly folded stop panel can engage each other at their loading edges to prevent full extension of the inner piece or they can fail to engage at all, slip past each other, and the inner piece can be pulled all the way out of the outer sleeve.

The prior assembly method, therefore, is unreliable, costly, and slow, due mainly to the requirement of folding the stop flap and/or the stop panel by hand, and inserting the inner sliding piece into the sleeve by hand. This prior process would become even more complicated and uneconomical if it were attempted in the various options provided by the present invention.

Sliding packages can also be made in the form of boxes, but the complications described above, and the added steps required to make a package into a box would render the use of stop flaps and panels prohibitively expensive.

Thus, there is a need for a package with an outer sleeve and interlocked sliding piece that is reliable, useful, economical to manufacture, and adaptable to numerous package shapes and arrangements.

SUMMARY OF THE INVENTION

The present invention is directed to an economical package for display and direct mail use and has an outer sleeve and an inner sliding piece. The inner sliding piece can be pulled at least partially from the outer sleeve until it reaches a positive and defined stopping point, and it then can be slid back into the outer sleeve. The inner sliding piece can reveal a card, other product, or a message as it is pulled from the outer sleeve. The package is economical and is so versatile it can be used in a variety of embodiments including retail display packages, direct mailers, boxes, books, and toys.

The present invention is economical to produce compared to prior alternatives because the stopping mechanism can be formed automatically due to its design and reliability. With the stopping mechanism automatically formed, it is also possible to automatically assemble the package. The inner sliding piece can be formed and folded, and the outer sleeve can be formed, folded and glued with the inner sliding piece already in place in a completely automated process. Further, in-line application of gift cards or other products to the sliding piece is possible as the package is being automatically assembled.

The present invention meets and exceeds all of the package requirements of prior packages and it has a more reliable locking mechanism. It is also possible to manufacture and completely assemble the present invention using existing automated tipping, folding, and gluing equipment, including the in-line application of gift cards or other product being sold or mailed. A reliable sliding and locking mechanism in the present invention allows the package to be used in many more applications than previous alternatives, even including magazine inserts, pamphlets, books, toys, and other products not previously considered due to the complexity of prior sliding designs. In addition, there are several embodiments of the present invention that allow automated assembly that bring many additional features to further differentiate the package and its products.

A package in accordance with the present invention includes: an outer sleeve having a first panel, a slide flap joined to and folded at least partially over the first panel and having a slide portion, a second panel joined to the first panel to define the outer sleeve with an inner space and an opening, and a stop panel joined to the slide flap and extending transversely at least partially across the inner space; and an inner sliding piece disposed at least partially between the first panel and the second panel, the inner sliding piece including a stop flap folded at least partially over the inner sliding piece and disposed at least partially between the outer sleeve's slide flap and the second panel for movement between a sliding position and a stop position in which the inner sliding piece extends at least partially out of the outer sleeve and the stop flap is at least partially disposed between the stop panel and the second panel of the outer sleeve.

The first panel can be joined integrally with and folded at least partially over the second panel of the outer sleeve, and the two panels can be substantially the same size or different shapes and sizes.

The package outer sleeve stop panel can be disposed adjacent to the opening in the outer sleeve. The opening can be along any edge of the finished package. Also, the outer sleeve stop panel can extend substantially completely across the opening or only partially across. Multiple stop panels can be used and they can extend in from opposite sides.

The package slide flap can include a glue portion adjacent to an edge of the outer sleeve to define an area where the first and second panels are joined together. The slide flap slide portion can be adjacent to an inner edge of the slide flap to avoid interference with the glue portion.

The slide flap slide portion preferably guides the inner sliding piece continuously between the sliding position and the stop position. The slide flap slide portion can include an inner edge that guides the sliding piece to slide in a substantially straight direction or in a curved or wave movement.

The package inner sliding piece can include a central card-supporting portion, it can be used to display designs or information, or it can include cut outs.

The stop flap can have one or more ears that extends to be at least partially disposed between the slide flap sliding portion and the second panel of the outer sleeve.

The sliding portion can be of the same or a substantially different shape than the outer sleeve.

The package can also be telescoping with multiple outer sleeves disposed at least partially in one another. The telescoping version can include a second outer sleeve having a first panel, a slide flap joined to and folded at least partially over the first panel and having a slide portion, a second panel joined to the first panel, and a stop panel extending transversely at least partially across an internal space defined by the first panel and the second panel of the second outer sleeve; and the first outer sleeve further comprises a second stop flap folded at least partially over the first outer sleeve and the slide flap of the second outer sleeve and disposed at least partially between the sliding portion of the slide flap and the second panel of the second outer sleeve for movement between a sliding position and the stopping panel of the second outer sleeve.

The package can also include a removable security tab joined to the outer sleeve.

As another option, the package inner sliding piece can be pivotably joined to the outer sleeve for pivoting movement about a pivot location.

The package in some embodiments is made of sheet material and is essentially flat. Other embodiments can include an inner sliding piece and an outer sleeve that are formed into three-dimensional shapes to form sliding boxes or tubes, for example.

A package in accordance with the present invention can also include an outer sleeve having a first panel, a second panel, a slide flap disposed between the first panel and the second panel, and a stopping panel disposed between the first panel and the second panel; and an inner slide disposed at least partially between the first panel and the second panel, and the slide includes a flap stop disposed between the slide flap and the second panel when the slide is in a sliding position, and between the stopping panel and the second panel when the slide is in a stop position.

BRIEF DESCRIPTION OF THE DRAWINGS

FIG. 7*a* is a perspective view of a third alternate embodiment with a security tear off strip at the bottom of the completed package;

FIG. 7*b* is a perspective view of the third embodiment of FIG. 7*a* without a bottom tear tab;

FIG. 13 is a perspective view of an eighth alternate embodiment having a stop flap with ears that are spaced apart to allow a wider package to be produced;

FIG. 14*a* is a perspective view of a ninth alternate embodiment of the present invention having an outer sleeve cut, but not folded and having upper and lower sets of stop panels to allow the inner sliding piece to be placed in either the open or closed positions of the final package;

FIG. 14*b* is a perspective view of an inner sliding piece for use with the sleeve of FIG. 14*a;*

FIG. 14*c* is a perspective view of the sleeve of FIG. 14*a* and the inner sliding piece of FIG. 14*b* in an assembled state;

FIG. 19*a* is a perspective view of a prior art outer sleeve with a stop flap folded up from the bottom;

FIG. 19*b* is a perspective view of a prior art sliding piece with a stop flap folded under a top part of the sleeve;

FIG. 19*c* is a perspective view of a prior art package using the parts illustrated in FIGS. 16*a* and 16*b;*

FIG. 19*d* is a cross-section of a prior art locking mechanism of the package in FIG. 19*c;*

DETAILED DESCRIPTION OF THE DRAWINGS

Figure 1:
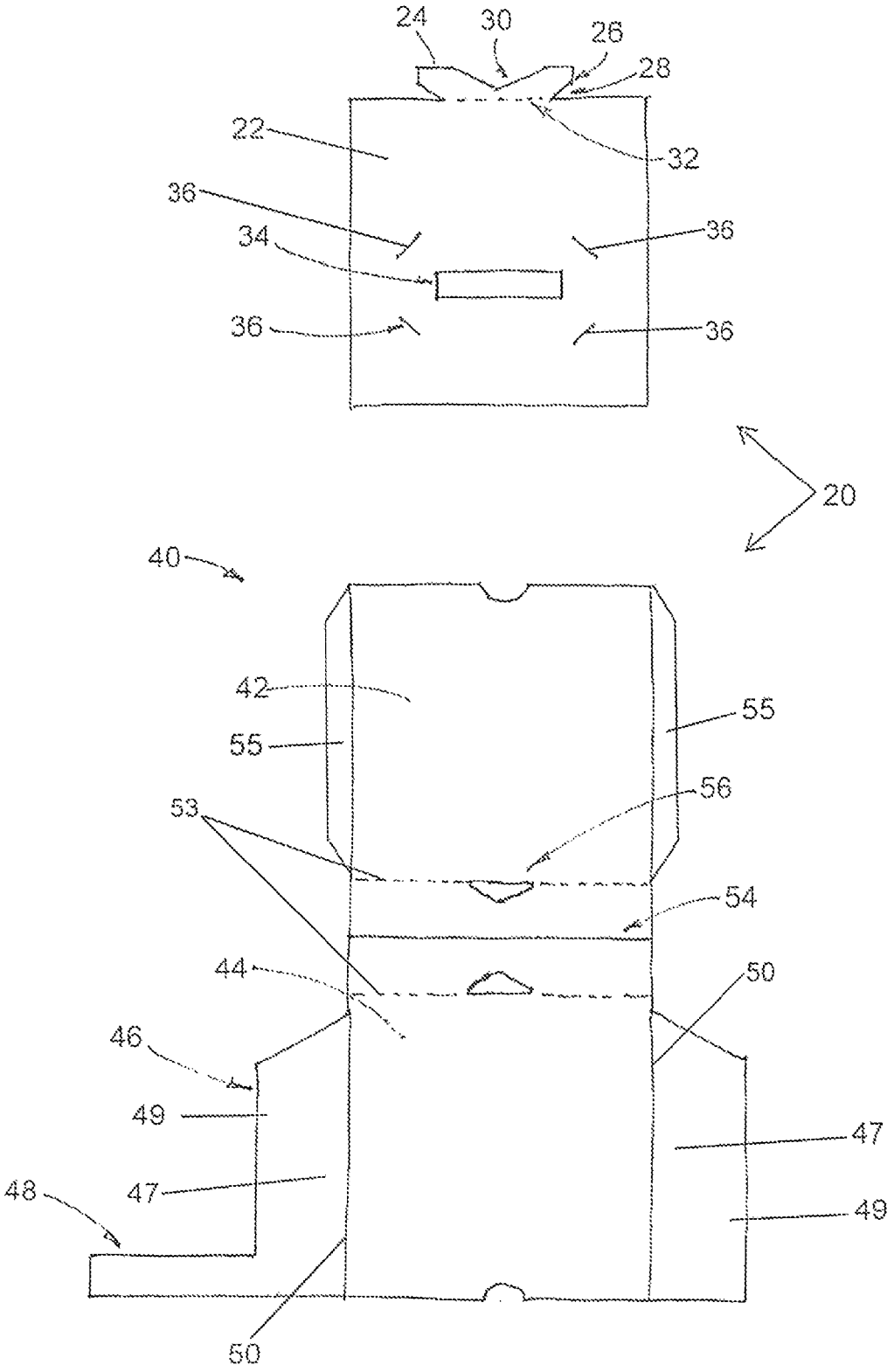
FIG. 1 is a top view of an inner sliding piece and an outer sleeve, before folding and assembly, in accordance with the present invention.

In the following detailed description of the drawings, the same reference numeral will be used to identify the same or similar item in each of the figures. Also, some of the terms used herein are relative, such as top, bottom, back, front, left and right, for example. They are used in reference to the drawings and are not intended to otherwise limit the scope of the invention.

Depicted generally in FIG. 1 is a sliding package 20 in accordance with the present invention. In this figure, the sliding package 20 is depicted in an unassembled and flat condition for ease of reference. A description of an assembled sliding package 20 and methods for manufacturing the package of FIG. 1 is provided below in relation to FIGS. 2 to 4*a*, and 15.

The inner sliding piece 22 is of a generally rectangular shape as depicted, but as described below, it can be other shapes, as well. The inner sliding piece 22 includes a stop flap 24 with ears 26 that extend outwardly and away from the inner sliding piece 22. The stop flap 24 is preferably formed integrally with the sliding piece 22, but they can be formed separately and joined together. The ears 26 are preferably spaced apart from stop flap 24 at a relief cut 28 for ease of folding the stop flap 24 along the fold line 32.

The sliding piece 22 can include a window 34 and slits 36 for use in packaging a gift card, for example. A gift card 60 can be positioned with its corners in the slits 36 and card information, such as a name, design, or bar code, will be visible through the window 34. These are optional features that are useful when displaying and packaging gift cards 60, but the sliding package 20 can be used just to display information, display advertising, provide play value, or even be shaped as a box, for example.

The outer sleeve 40 in FIG. 1 includes a front panel 42, a back panel 44, slide flaps 46, and a stop panel 48. During assembly, the front panel 42 can be folded downward (as viewed) over a fold line 54 and joined to the back panel 44 to form a pocket into which the sliding inner piece 22 is disposed. One way to join the front panel 42 to the back panel 44 is to glue the front panel 42 to a glue portion 49 of the slide flaps 46 of the back panel 44. Another option is to use glue flaps 55 on the top panel 42 that are glued to the bottom panel 44. If this latter method is not used, the glue flaps 55 are not necessary and can be omitted. Other ways for joining the front panel 42 to the back panel 44 include using tape, staples, fusion, or any other suitable device or method.

The back panel 44 and the front panel 42 are sometimes referred to below and in the claims as a first panel and a second panel, respectively, to avoid confusion because they can be flipped around in various embodiments. The slide flaps 46 are preferably folded around a score 50. Perforations 53 can be provided to remove the upper end of the outer sleeve 40 to transform it from a hanging display using the hang holes 56 to a gift package without the hang holes 56.

The inner sliding piece 22 and the outer sleeve 40 are preferably formed or cut from a larger piece of paper, paper board, cardboard, plastic, wood, fabric, or any suitable material including sustainable materials. Die cutting works well, but other methods can be used to form the pieces.

As seen in FIGS. 2 through 4*a*, the slide flaps 46 can include a glue portion 47, a slide portion 49, and a guiding edge 51. When used, the glue portion 47 receives glue for joining the top panel 42 to the bottom panel 44. There need not be a definitive line separating the glue portion 47 and the slide portion 49, and a guiding edge 51. It is only necessary that glue on the glue portion 47 not interfere with the stop flap 24 sliding on the slide portion 49 or being guided by the edge 51, if this feature is used in the package.

The slide portion 49 can be present on one or, preferably, both sides of the outer sleeve 40, and can guide the inner sliding piece 22 while being pulled from the package in at least two ways. First, the slide portion 47 guides the inner sliding piece stop flap 24 as it slides between the slide portion 49 and the top panel 42. By being sandwiched in this way, the stop flap 24 will always positively engage the stop panel 48 when the stop flap 24 reaches the end of the sliding position to be in a stop position. The positive engagement in the stop position results in a locking mechanism formed by the ears 26 of the stop flap 24 being folded on top of the slide flap 46 sliding portion 49, so that the stop flap 24 "hooks" the stop panel 48. (See FIGS. 2 to 4*a*.) Also, the inner edges of the slide panels 46 can engage the stop tab 26 to maintain alignment. As described above, there is a sliding position when the stop flap 24 is sliding between the slide portion 49 and the top panel 42. At the extreme end of sliding position, is the stop position in which the stop flap 24 is engaged with the stop panel 48.

The arrangement and size of the stop flap 24 as shown in FIGS. 1 through 4*a* is folded forward over the sliding insert 22 from the top so that the ears 26 extend over and lay and slide on top of the slide flap 46 slide portion 49 and then positively engage the stop panel 48 that is folded over from the side. With this arrangement, full extension of the inner sliding piece 22 and reliable engagement between the inner sliding piece 22 and the outer sleeve 46 is assured because there is no way for the slide flap 46 to "butt" into the stop panel 48 or by-pass the stop panel 48, as described below in relation to prior designs.

Also, the sliding portion 49 of each slide panel 46 includes the edge 51 that can be used to guide the stop flap 24 in any desired direction, such as straight or in curved lines as described below.

The package 20 can be formed automatically because the outer sleeve stop panel 48 is created by folding it in from the side along score lines 50 (FIG. 1), as opposed to upwardly from the bottom. The stop panel 48 preferably extends across the full width of the package 20, but it is not necessary. Indeed, shorter stop panels can extend in from both sides and extend only partially across the width, if desired. In any of these options, the stop panel 48 simply extends laterally inwardly beyond the edges 51 and into the gap between the slide flaps 46 to engage the stop flap 24 in the stop position.

Also, the stop flap 24 on the inner sliding piece 22 is created by folding forward and downward (as illustrated) along a fold line 32. This can be done in a separate folding step or simultaneously with folding open the top panel 42. Either way, the package 20 can be automatically and economically folded while creating a positive stopping arrangement for the inner sliding piece 22.

Figure 2:
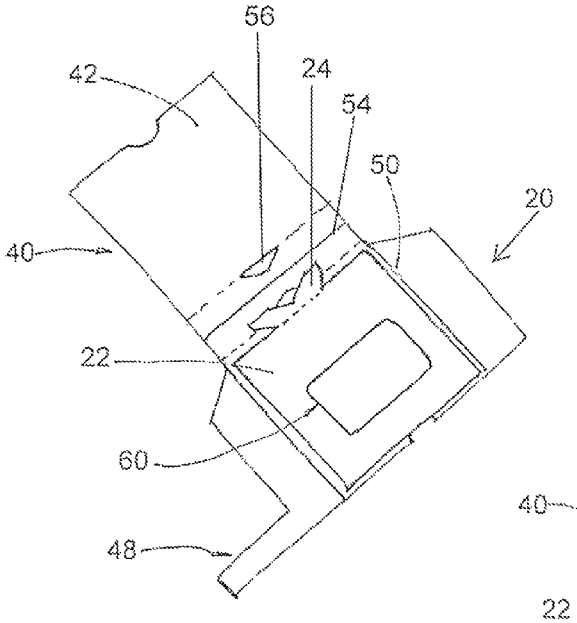
FIG. 2 is a perspective view of the inner sliding piece on top of the outer sleeve before the outer sleeve is glued and folded.

FIG. 2 illustrates the package 20 in a partially assembled state, but before any folding has occurred. FIG. 2 illustrates the inner sliding piece 22 on top of the unfolded outer sleeve 40. The optional glue flaps 55 from FIG. 1 are not included in these figures. The outer sleeve 40 is fed into a folder/gluer leading with the top panel 42. The inner sliding piece 22 is tipped on to the unfolded outer sleeve. At this point there is an optional feeding of a gift card 60, sachet, or other flat product and attaching it to the inner sliding piece by glue or other attachment means. (See also the description of FIG. 15*b* below.)

Figure 3:
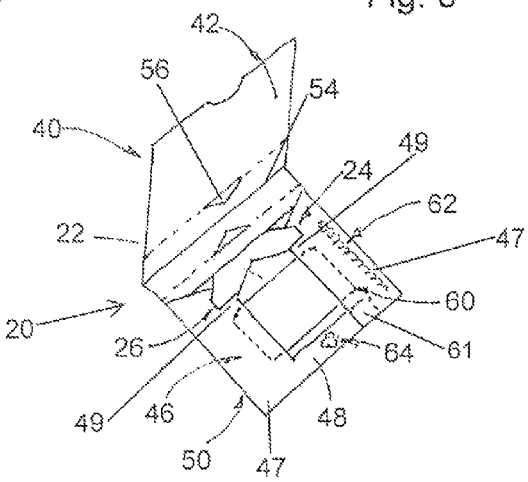
FIG. 3 is a perspective view of the product with a stop flap of an inner sliding piece folded over slide flaps on the outer sleeve, and the outer sleeve partially folded.

FIG. 3 illustrates the results of at least two more steps of the process with the slide flaps 46 folded over the inner sliding piece 22 and with an attached gift card 60. The slide flaps 46 have glue applied at their respective outer glue portions 47, but with no glue near the inner sliding portions 49 of the slide flaps 46, where the stop flap 26 overlaps the slide flaps 46. The stop panel 48 can extend transversely so that it overlaps the opposite slide flap 26 and the two can be glued together at 61, but as stated above, the stop panel 48 need not extend all the way across the package 20.

In this embodiment, the stop flap 24 is folded over the inner sliding piece 22 such that the ears 26 now extend on top of the unglued slide portion 49 of the slide flaps 46. FIG. 3 also shows the process of the top panel 42 being folded over the body of the outer sleeve 40 to sandwich the stop flap 24 between the slide portion 47 and the top panel 42. This causes the stop flap 24 of the inner sliding piece to always positively engage the stop panel 48 of the outer sleeve 40 when pulled out of the outer sleeve 40. In addition, the width of the stop flap 24 can be matched to the size of the gap between the inner edges of the folded slide flaps 46, so that the inner sliding piece 22 is guided as it slides.

In this folding operation, glue is applied in the glue portion 47 along the slide flap 46 close to the score 50, but away from the slide portion 49 where the ears 26 will slide. Optionally, glue can be applied to the stop panel 48 in area 64 illustrated in FIG. 3 to glue the top panel 42 to the stop panel 48 if further strength or security is required.

Figure 4:
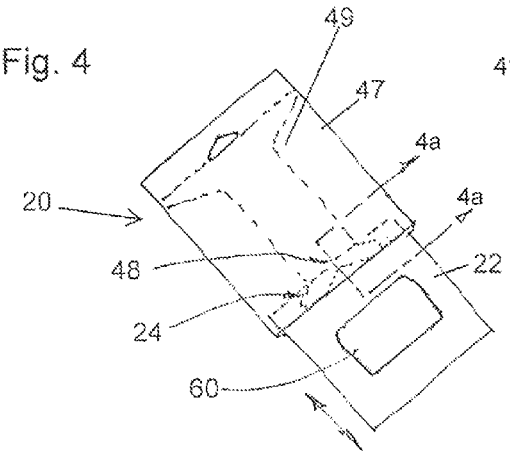
FIG. 4 is a perspective view of a completed package with the inner sleeve pulled out to the stop point to reveal the gift card.

FIG. 4 shows the assembled package 20 with the inner sliding piece 22 extending out of a bottom opening in the package 20 to reveal the gift card 60. The inner sliding piece 22 is at the stop position where the stop flap 24 is engaging ("hooked on") the stop panel 48. Prior to reaching the stop position, the inner sliding piece 22 is in a "slide position" as it moves between its inner-most position and the stop position.

Figure 4A:
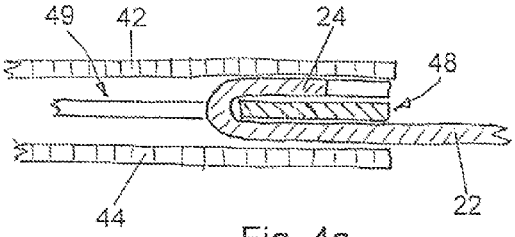
FIG. 4*a* is a cross sectional view of a locking mechanism created between the stop flap of the inner sliding piece and the stop panel of the outer sleeve in the fully extended position.

FIG. 4*a* is a cross-section of the stop flap 24 engaged with the stop panel 48 where the hinge (or fold line) created by the sliding stop flap 24 in assembly creates a firm stop position for the stop panel 48.

The above described embodiment 20 is useful in a single slide opening display and mail package, for example. As described below in relation to FIG. 15*b*, it can be made with a single pass on a folder gluer including the addition of a gift card or other product, unlike previously known designs. The sliding function of the inner sliding piece 22 when in a sliding position is accurate and smooth, and the stop position (FIG. 4) is positive and consistent for multiple operations given the design and assembly process.

Figure 5:
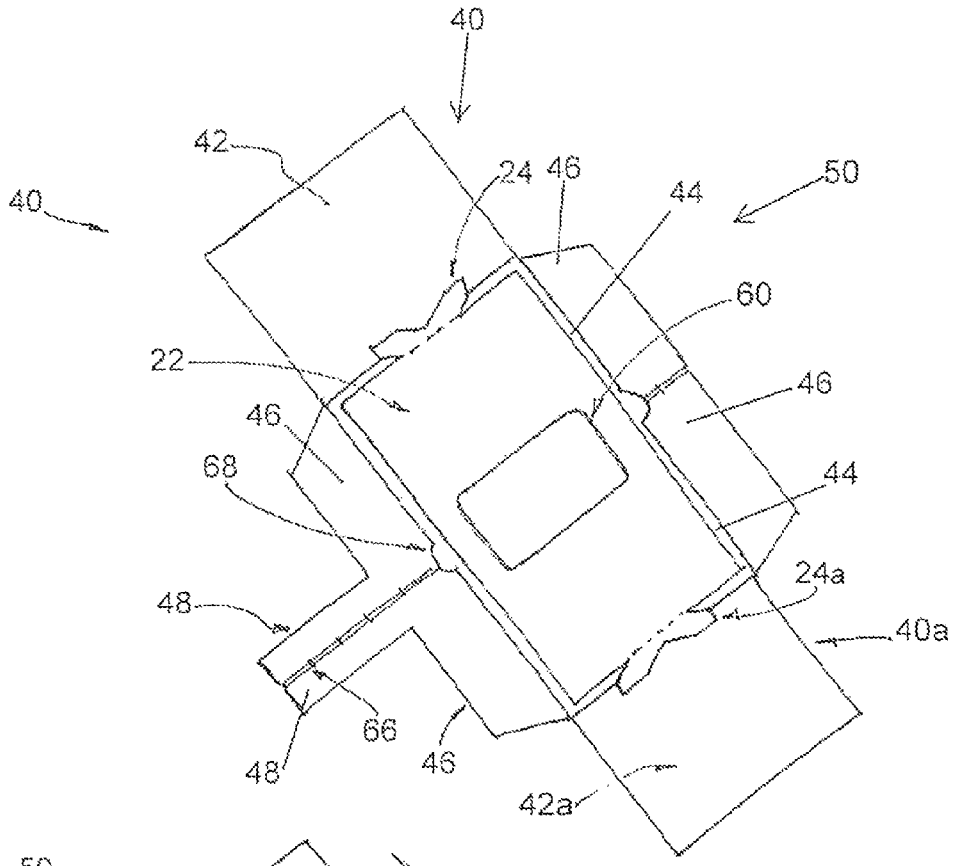
FIG. 5 is a perspective view of a second alternate embodiment of the invention with an insert in place on top of two unfolded outer sleeves to create a double sliding opening package.

FIG. 5 shows an alternate embodiment 50 of the invention, a "double slider." In the embodiment 50, the inner sliding piece 22 includes two stop flaps 24 at opposite ends of the inner sliding piece 22. Each outer sleeve 40 and 40*a* includes a top panel 42, a back panel 44, slide flaps 46, and a stop panel 48. The inner sliding piece 22 is long enough to extend into both outer sleeves 40 and 40*a*.

Figure 6:
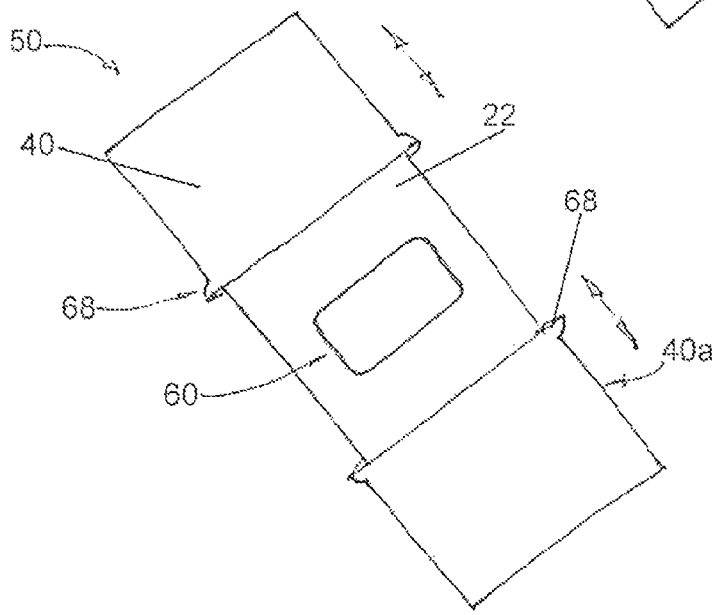
FIG. 6 is a perspective view of the embodiment shown in FIG. 5, with the inner sliding piece fully exposed by pulling the two outer sleeves in opposite directions.

As depicted in FIG. 6, the assembled double slider package 50 allows both outer sleeves 40 and 40*a* to slide relative to the inner piece 22 to expose the inner piece 22 and a gift card 60 disposed on the inner piece 22 in a manner described above. In this embodiment, a top outer sleeve 40 can be simultaneously die cut and attached to a bottom outer sleeve 40*a* with breakable nicks 66. Optionally for tamper evident security, the attached outer sleeves 40 and 40*a* can have die cut tear tabs 68 that hold them together during assembly, retail display and mailing. In the manufacturing assembly process, both outer sleeves 40 and 40*a* are fed simultaneously on a folder/gluer and the inner sliding piece 22 is tipped on with two foldable stop flaps 24 and 24*a* on opposite ends, as described below in relation to FIGS. 15 through 15*d*. As in the first embodiment of a single slider, an optional product like a gift card 60 can be tipped on the inner sliding piece 22 at this point.

The slide flaps 46 of both sleeves 40 and 40*a* are folded over the inner sliding piece 22 and glued together at least where the stop panels 48 overlap the opposite slide flaps 46. Each top sleeve top panel 42 and bottom sleeve top panel 42*a* is folded and glued to glue portions 47 of the slide flaps 46 with optional glue 64 on the stop panels 48 for improved strength. The top panel 42*a* on the lower sleeve 40*a* is folded up and over the package, but it must be folded in the same direction the package 50 is moving on the assembly belt described below. Therefore, the package 50 can be turned 90° or 180° to enable folding.

To achieve further security, the top and bottom outer sleeves 40 and 40*a* may have had optional tear tabs 68 that must be torn off at perforations to separate the two outer sleeves 40 and 40*a* and to provide a visual indication of tampering and security. This double slider package embodiment 50 provides even more of an economic advantage in that three moving parts 24, 40, and 40*a* are assembled in the same operation, both sleeves 40 and 40*a* have accurate and smooth sliding, and the stop flaps 24 and 24*a* have consistent and positive stopping points for multiple sliding operations. In this embodiment, the outer sleeves 40 and 40*a* are pulled in opposite directions to expose the inner sliding piece 22, and both may reach their extreme sliding limits simultaneously or at different times.

A third embodiment 82 is shown in FIGS. 7*a* and 7*b*, as a single slide opening display and mail package 82 similar to the first embodiment 20. In the FIG. 7*a* embodiment a tear off top strip 81 is used and includes a hang hole 83. In the FIG. 7*a* embodiment, an optional tear strip 72 can be included along the bottom edge of the package 82 to close the package 82 on all four edges, but the bottom tear strip 72 is not included in FIG. 7*b*. The tear strips 72 and 81 are formed by lengthening the top and bottom panels 42 and 44 of the other sleeve 40, and adding perforations 73 along the edges of both panels 42 and 44. These embodiments afford a highly secure package in that the inner sliding piece 24 is not accessible until a consumer or other user tears off the tear strip 72 along the bottom of the package 82 that can be removed to expose the inner sliding piece 22. This feature is highly valued for gift cards and other products of higher value; however this embodiment can be made at a reduced cost compared to prior alternatives.

Figures 8A, 8B:
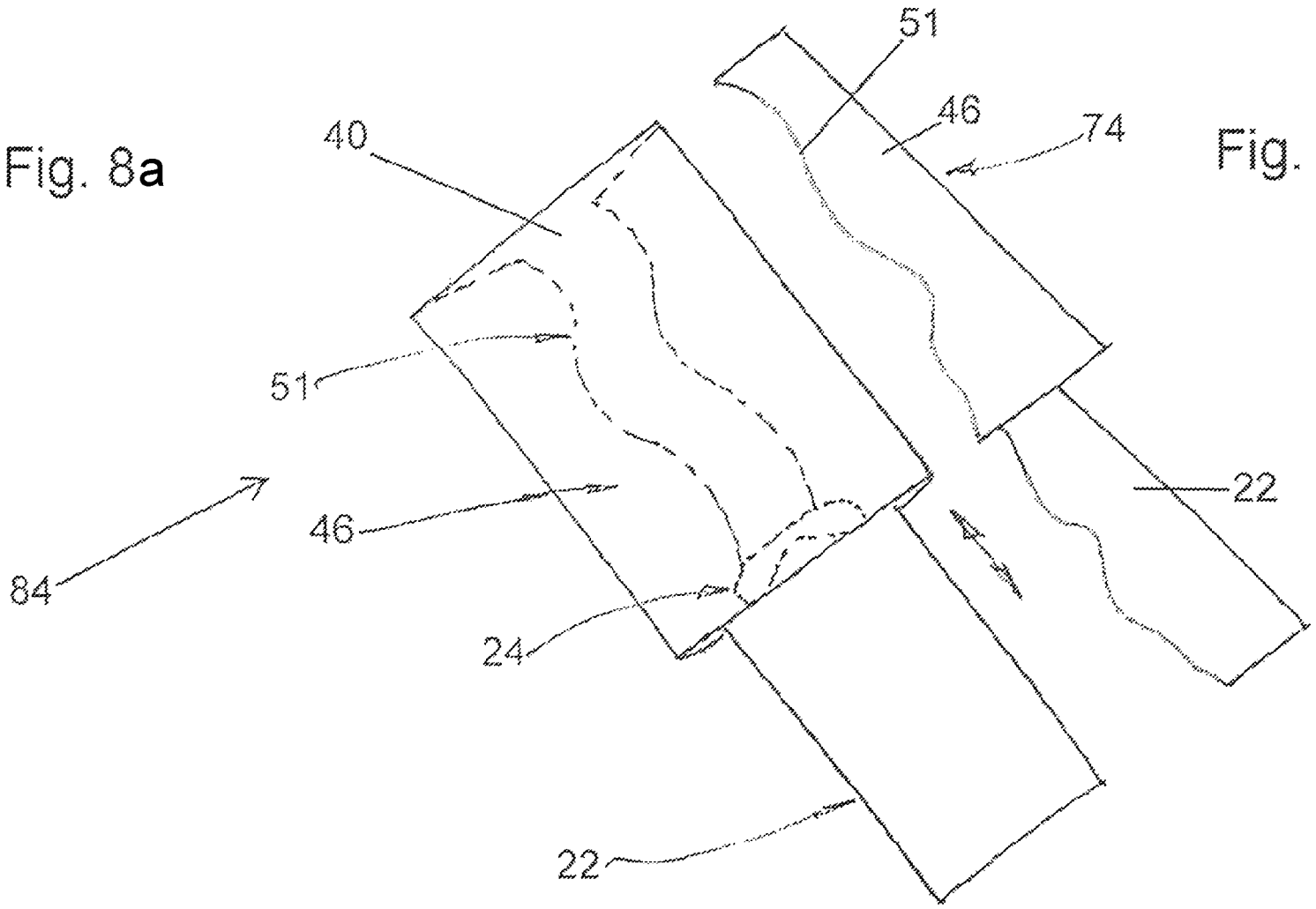
FIG. 8*a* is a perspective view of a fourth alternate embodiment of the present invention in which the outer sleeve slide flaps are shaped to create lateral movement of the inner sliding piece as it is pulled out of the sleeve.
FIG. 8*b* is a partial perspective view of the fourth embodiment of FIG. 8 except that the outer sleeve is trapezoidal in shape.

FIG. 8*a* shows a fourth embodiment 84 of the invention, in which the slide flaps 46 act as a guide to the stop flap 24 on the inner sliding piece 22. The edges 51 of the slide flaps 46 can be die cut with any desired shape that will provide some sliding lateral or "wave" movement to the inner sliding piece 22 as it is pulled from the outer sleeve 40. To allow for this movement, the inner sliding piece 22 can either be narrower than the outer sleeve 40, or the shape of the outer sleeve 40 can be trapezoidal or another shape where the top of the sleeve 40 is narrower than the bottom of the sleeve 40, as shown in partial view in FIG. 8*b*, 74. The fourth embodiment 84 as illustrated in FIGS. 8*a* and 8*b* also allows for lateral movement of graphics, through openings (not illustrated) in the top panel 42 or bottom panel 44 of the package, making the package very useful for a direct mail promotional piece and for entertainment purposes.

Figure 9:
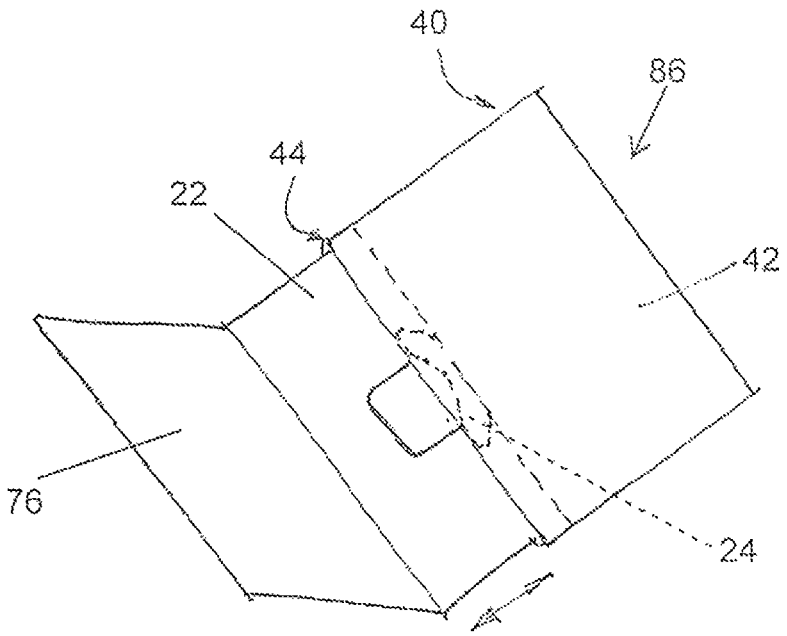
FIG. 9 is a perspective view of a fifth embodiment of the present invention in which the inner sliding piece has an attached cover panel for folding over the outer sleeve to create a greeting card.

FIG. 9 shows of fifth embodiment of the invention where the package 86 is designed as a greeting card. The inner sliding piece 22 is assembled inside an outer sleeve 40 as in the original embodiment, but in addition, a panel 76 is added to an edge of the inner sliding piece 22 that is opposite the stop tab 24 and folded over the outer sleeve 40 toward either the top panel 42 or the bottom panel 44. The additional panel 76 can be oriented to be on the side of the package 86 or horizontally along the top or bottom. After the panel 76 is opened to reveal graphics or die cut openings to the inner sliding piece 22, the inner sliding piece 22 can be pulled out of the outer sleeve 40 to reveal a message, gift card 60, sachet, or other promotional product. This embodiment allows significantly more space for graphics, information, or product placement and retains both the positive stop to allow for reuse and the economical assembly options, as described herein.

Figure 10:
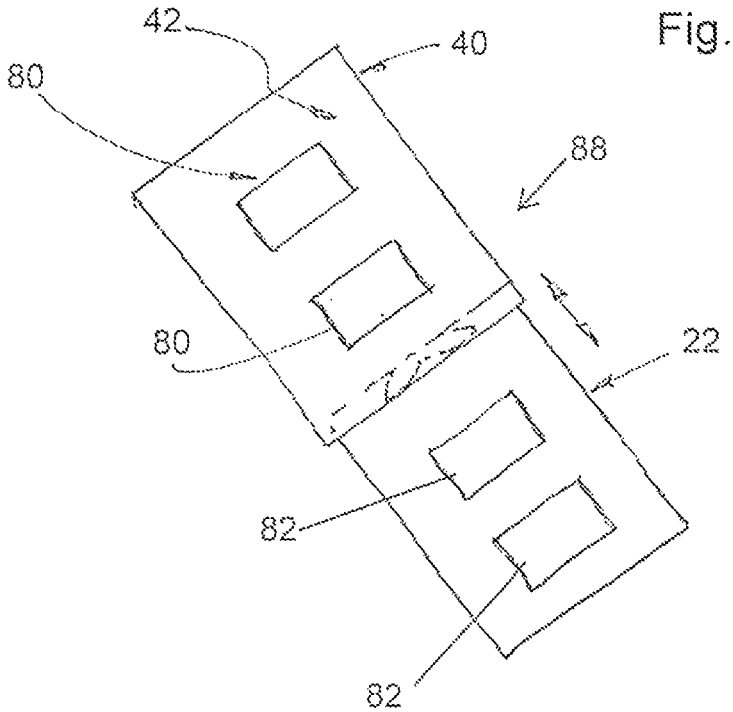
FIG. 10 is a perspective view of a sixth embodiment of the present invention having an inner sliding piece that reveals graphics as the sliding piece is drawn down to its stop.

FIG. 10 shows a sixth embodiment of a package 88 used to display changing graphics or messages as the inner sliding piece 22 is pulled from the outer sleeve 40. One or more messages or gift cards 60 are visible through die cut holes 80, and reveal a second set of one or more messages 82 as the inner sliding piece 22 is pulled from the outer sleeve 40. In this embodiment, the windows 80 are die cut in the front panel 42 or the back panel 44 of the outer sleeve 40, and preferably at locations so that the stop flap 24 is not visible as the inner sliding piece 22 is pulled from the outer sleeve 40. This embodiment is useful in displaying messages in selective fashion or can even be used as slide calculators and other useful devices.

Figure 11:
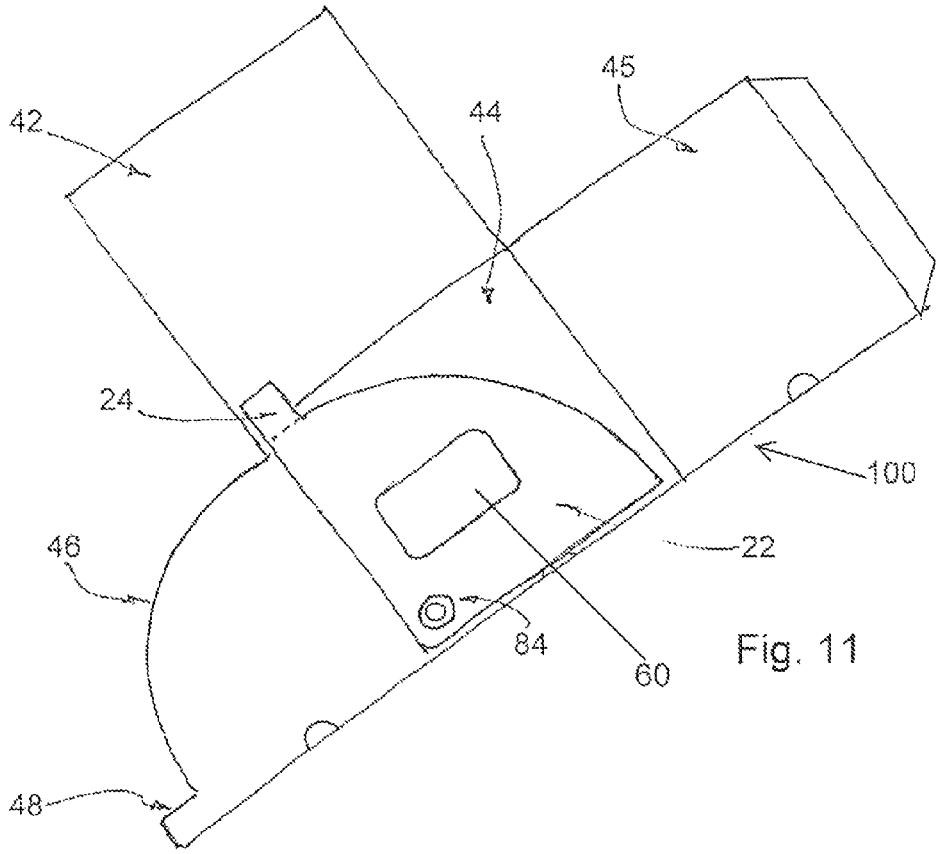
FIG. 11 is a perspective view of a seventh embodiment of the present invention in a partially assembled state and having an inner sliding piece that slides out of the outer sleeve by pivoting around a pivot point, to a final stop created by the folded-over stop flap in accordance with the present invention.
Figure 12:
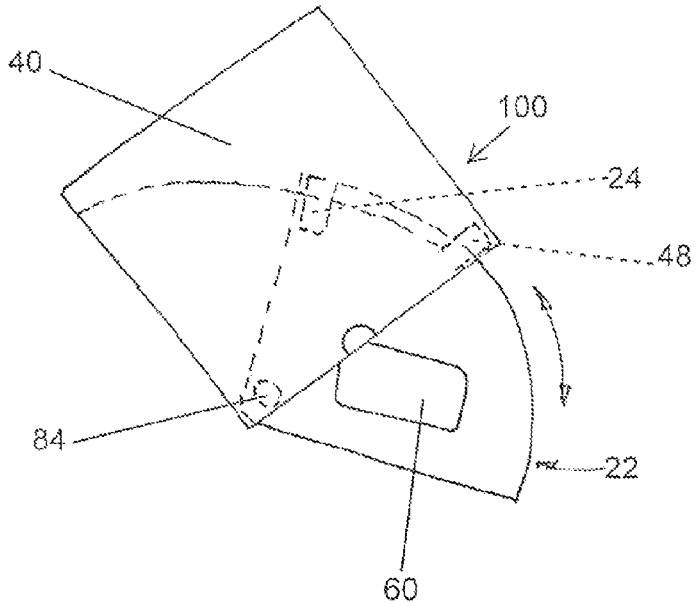
FIG. 12 is a perspective view of the completed product in FIG. 11 with the inner sliding piece pivoted out of the sleeve.

FIGS. 11 and 12 show a seventh embodiment 100 of the invention which is a slide opening and display mail package where the inner sliding piece 22 pivots out of the outer sleeve 40 around a pivot point 84 rather than in a straight line. The pivot point 84 can be created in a number of possible ways including being a die cut hole in the inner sliding piece 22 where glue is applied between a single slide flap 46 and the back panel 44 of the outer sleeve 40. Alternate pivot points are an eyelet, rivet, or other single point attachment means. A third panel 45 is optional to fully enclose the inner sliding piece 22. The stop flap 24 can be folded simultaneously with the top panel 42 in the assembly process and it slides along between the slide flap 46 and the top panel 42 as the inner sliding piece 22 is pivoted out of the outer sleeve 40 to reveal a gift card 60 or other promotional item such as a sachet. The stop flap 24 creates a positive stopping point against the stop panel 48 at the end of the travel.

This seventh embodiment 100, as shown assembled in FIG. 12 with the inner sliding piece 22 pivoted out of the outer sleeve 40, retains the design that allows the economic assembly of a sliding display and mail package with a positive stop position and the ability to reuse the package.

FIG. 13 shows a seventh embodiment 102 of the invention including a stop flap 24 with spaced apart ears 26 extending to either side of the package 102 in a slide position. In this embodiment, there are two stop panels, 48, one on each slide flap 46. The two stop flap ears 26 are folded over the slide flaps 46 and sandwiched between the top panel 42 and the slide flaps 46 when the top panel 42 is folded over. Each of the two stop flap ears 26 in this alternative, interlock with their respective stop panels 48 at a stop position when the inner sliding piece 22 is extended out of the outer sleeve 40. This allows for the production of a relatively wide package, where it would be impractical for the stop flap 24 to extend all the way across the package.

FIGS. 14*a* through 14*c* show a ninth embodiment 106 of this package which allows the inner sliding piece 22 to be placed anywhere along the line of travel within the outer sleeve 40, and allows for having both bottom stop panels 48*a*, and top stop panels 48*b* which is useful if it is desired or required that the top of the package 106 is open after the removal of an optional panel (not shown) with the hang hole.

In this embodiment, the stop flap 24 ears 26 are folded upward (FIG. 14*b*) while being tipped onto the carrier 40. The two slide flaps 46 are then folded inwardly and over the upwardly folded stop flaps 24. As the top panel 42 is folded over the slide flaps 46, the stop flap ears 26 are folded downward over the slide flaps 46 as shown in FIG. 14*c*. The top panel 42 can be glued along the edges to the slide flaps 46.

Figure 15:
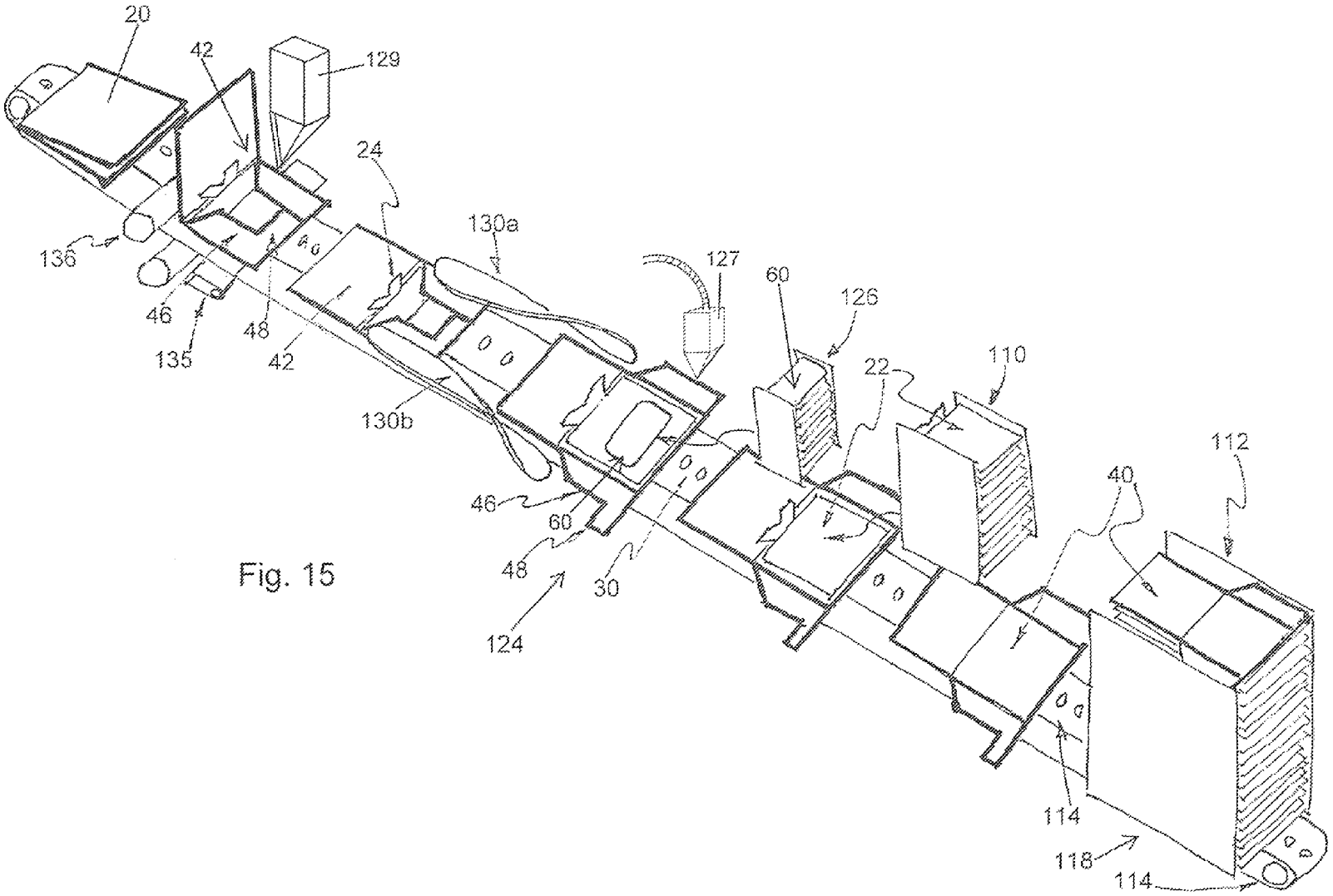
FIG. 15 is a perspective view of an assembly method in accordance with the present invention.

As illustrated in FIG. 15 with cross-reference to the above-described product drawings, the manufacturing process for the package 20 includes the following steps. The inner sliding piece 22 and the outer sleeve 40 are each die cut and scored from a suitable material for the application, which can be paper, paper board, card board, wood, plastic, or other flat foldable material such as fabric. The inner sliding piece 22 is die cut with the stop flap 24 having extended ears 26 and a relief 28 for folding. The stop flap 24 also contains a score 32 that can be formed by several optional ways to allow it to fold over the inner sliding piece 22 during assembly. The inner sliding piece 22 may also be die cut to form a window 34 to allow the reading of a bar code on an attached gift card or may have other features for mounting a card, such as die cut slits or holes 36. (See FIGS. 1 and 5, for example.)

As illustrated in FIG. 15, the die cut inner sliding pieces 22 are placed in a feeder having a feed hopper 110 and the die cut outer sleeves 40 are placed in a feed hopper 112, which is arranged over a suitable vacuum belt 114 at a first position 118. Outer sleeves 40, as seen in FIGS. 1 and 5, are first fed onto the vacuum belt 114 using belts or vacuum, for example, and moved to a second position 120 where sliding inner pieces 22 are tipped onto the outer sleeve 40, using belts or vacuum, for example. At a third position 124, gift cards 60 are tipped onto the inner sliding piece 22 from a feed hopper 126, again using belts, vacuum, or other suitable device. (See FIG. 2.)

Next, the three items 22, 40, and 60 move through left and right hand plows 130*a* and 130*b* that fold the slide flaps 46 and the stop panel 48 laterally over the inner sliding piece 22 and glue is applied at a glue station 127 to the slide flaps and the stop panel 48. The slide flaps 46 are spaced apart to define a gap between the slide flaps 46 through which a central part of the stop flap 24 moves as the sliding piece 22 slides until it reaches the stop panel 48. The stop flap ears 26 are at least partially disposed on top of the slide flaps 46 and under the top panel 42 to ensure proper operation of the stopping mechanism.

Optionally, glue is then applied to the glue portion 47 of the slide flaps 46 at glue station 129 and the package 20 moves toward an actuated plate 135 to fold the top panel 42 upward into a position (as seen in FIG. 5) allowing rollers 136 to fold down the top panel 42 of the sleeve and the stop flap 24 of the inner sliding piece 22 over the top of the package 20 to form the completed package illustrated at the upper left end of the belt 114 in FIG. 15. The top panel 42 and the back panel 44 can be secured together in other ways, including tape, Velcro, fusing, staples, etc.

Figure 15C:
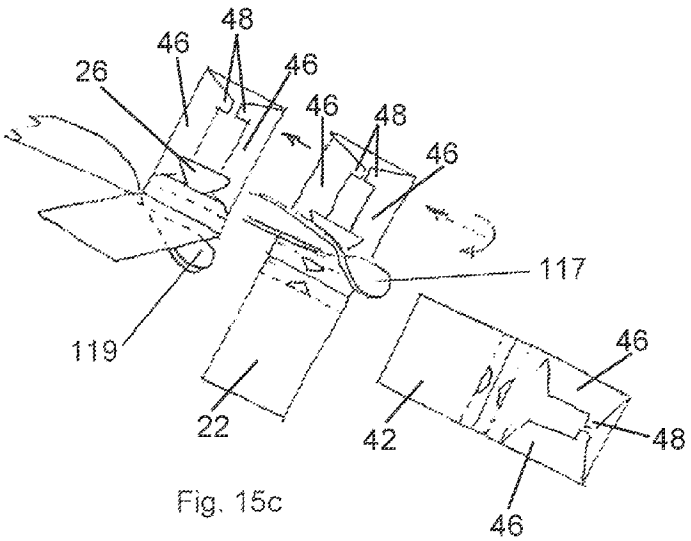
FIG. 15*c* is a perspective view of a package in a pivoted position and the stop flap and a top panel being folded in successive operations.
Figure 15D:
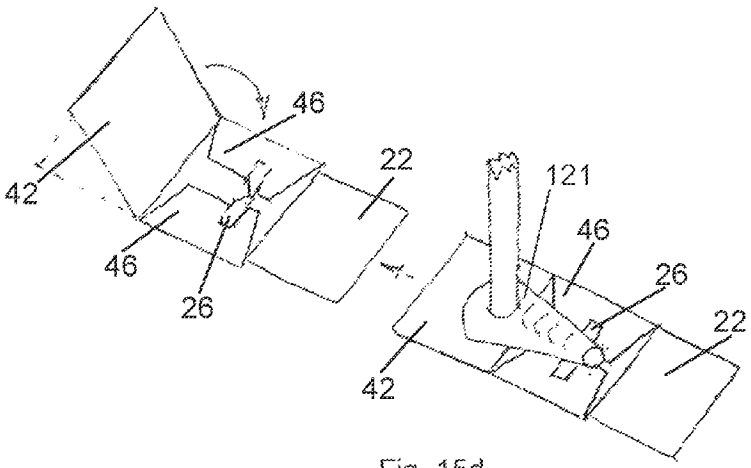
FIG. 15*d* is a perspective view of an alternate method for folding a stop flap.
Figure 15A:
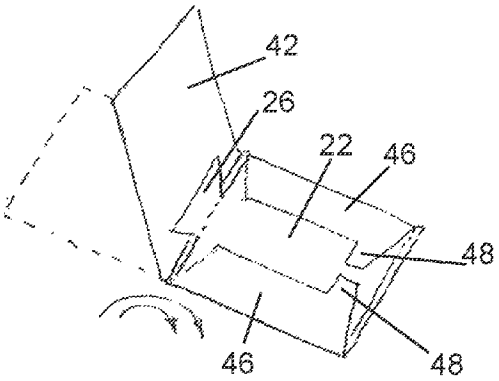
FIG. 15*a* is a perspective view of a top panel and stop flap being folded simultaneously.
Figure 15B:
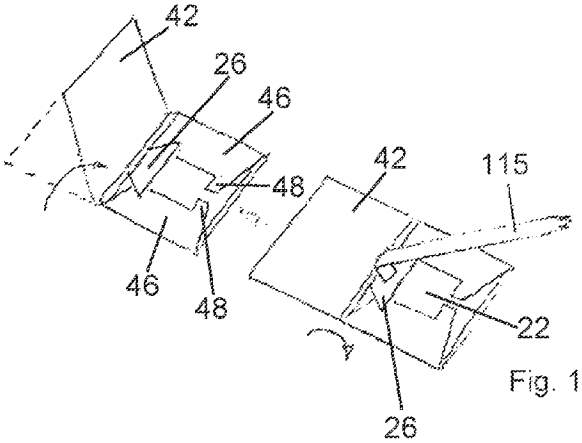
FIG. 15*b* is a perspective view of a stop flap and top panel being folded in successive operations.
Figures 16A, 16B, 16C, 16D:
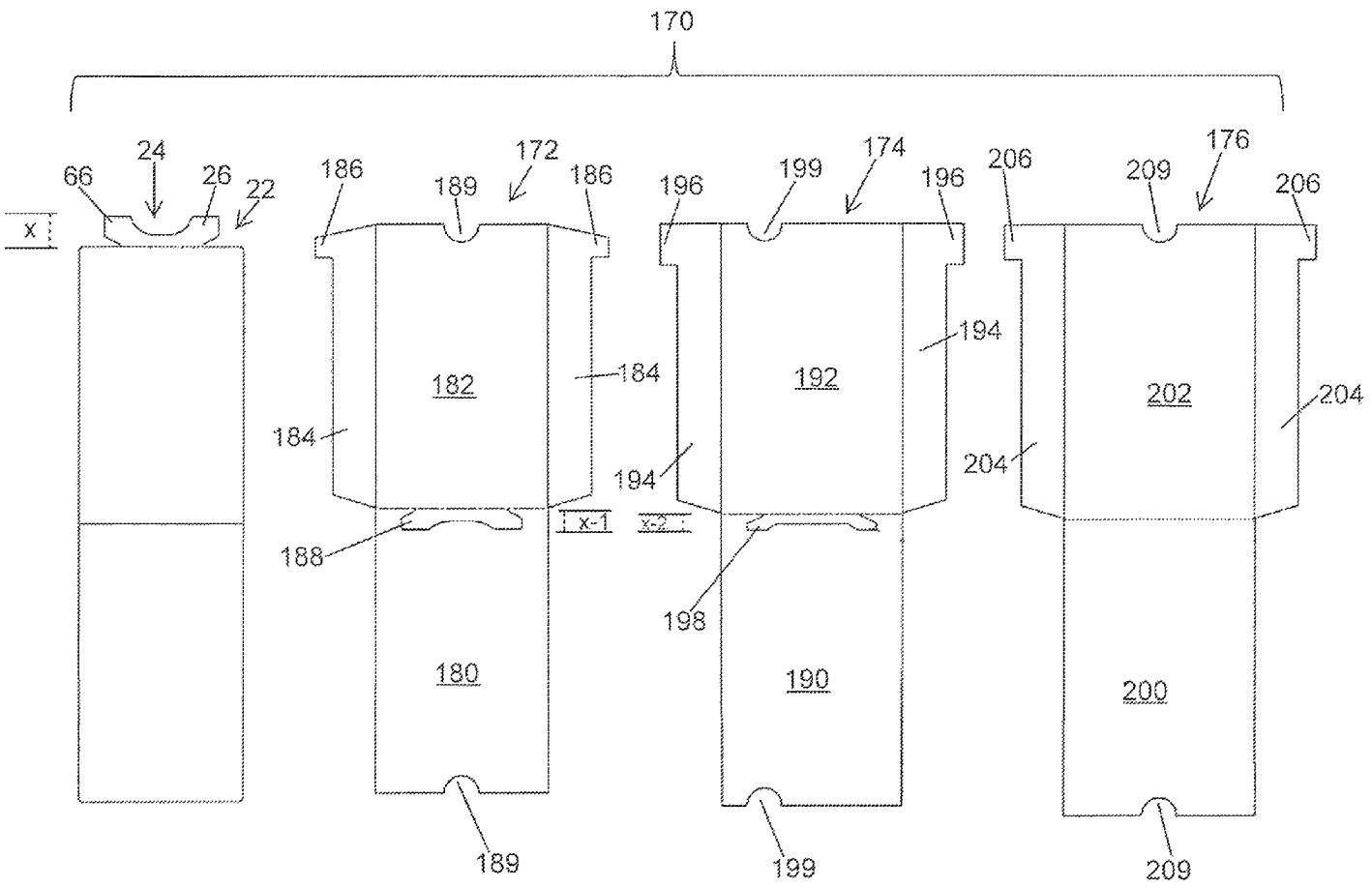
FIG. 16*a* is a top view of a sliding insert for use in a telescoping embodiment of the present invention.
FIG. 16*b* is a top view of a sleeve for use with the embodiments of FIG. 16*a;*
FIG. 16*c* is a top view of a sleeve for use with the embodiments of FIG. 16*a;*
FIG. 16*d* is a top view of a sleeve for use with the embodiments of FIG. 16*a;*

The package 20 illustrated in FIGS. 1 through 4*a* is made slightly differently as illustrated in FIG. 15*b*. For this embodiment, the inner sliding piece 22 is tipped onto the outer sleeve 40 so that the stop flap 24 is positioned below the fold line 54 and the hang hole 56. In this embodiment, a separate folding operation FIG. 15*b* is used to fold over the stop flap 24 by folder 115 before the top panel 42 is folded. (See also embodiment 100 in FIGS. 11 and 12.)

FIG. 15*c* illustrates an extra step necessary to make the embodiment 50 in FIGS. 1 to 4*a*. In this case, the package 20 has been pivoted 90° so that the stop flap 24 and the top panel 42 can be folded by the plows 117 and 119 in successive steps.

FIG. 15*d* illustrates yet another folder 121 for folding over the stop flap 24.

The method of folding illustrated in FIG. 15 is only one option for folding on a common folder available to the industry. There are other optional methods to achieve the above-described interlocking by folding and gluing the slide flaps 46 and folding the stop flap 24 over the slide flaps 46. For example, the slide flaps 46 can be folded as shown, but the outer sleeve 40 can then be rotated ninety degrees on the press and the stop flap 24 and the top panel 42 can be folded over. (FIG. 15*c*.) In addition, there are many alternative ways to feed the outer sleeve 40, the inner sliding piece 22, and any additional promotional piece such as the gift card 60. Many different feeder variations exist to accomplish the end folding step.

After assembly, the top stop panels 48*a* interlock with the folded over stop flap ears 26 to stop travel inward of the inner sliding piece 22. The bottom stop panels 48 interlock with the folder over stop flap ears 26 to stop travel of the inner sliding piece 22 in an outward direction from the outer sleeve 40. The inner sliding piece 22, could slide out of the bottom or top or both ends of the outer sleeve 40 even though the illustrated embodiment is opened only at the bottom.

FIGS. 16*a* through 16*d* illustrate another embodiment 170 of the present invention that is a telescoping set of sleeves 174, 176, 178 with a sliding inner piece 22. The telescoping embodiment 170 includes a sliding inner piece 22, as described above, a first sleeve 172 that receives the sliding piece 22 and is itself an insert in the second sleeve 174, and the second sleeve is for inserting into the third sleeve 176.

The first sleeve 172 includes a front panel 180, a back panel 182, slide flaps 184, stop panels 186, and a stop flap 188. An optional finger notch 189 is also provided at the top and bottom so that the inner sliding piece 22 can be pulled out. In the alternative, slots or extensions can be provided to enable the parts to be easily grasped for operation.

Similarly, the second sleeve 174 includes a front panel 190, a back panel 192, slide flaps 194, stop panels 196, and a stop flap 198. An optional finger notch 199 is also provided at the top and bottom so that the inner sliding piece 22 can be pulled out.

Similarly, the third sleeve 176 includes a front panel 200, a back panel 202, slide flaps 204, and stop panels 206. An optional finger notch 209 is also provided at the top and bottom so that the inner sliding piece 22 can be pulled out.

The telescoping embodiment 170 is illustrated with three sleeves, but two, four, or any other desired number can be used. Further, this embodiment can be used or combined with other embodiments described herein, including the pivoting embodiment of FIG. 12.

In the manufacturing operation of the telescoping embodiment 170, the inner sliding piece 22 is assembled into the first sleeve 172, as described above. Next, the assembled first sleeve 172 is treated as an inner sliding piece in the second sleeve 174 in the above-described steps. Finally, the assembled second sleeve 174 is treated as a sliding insert in the third sleeve 176 in the above-described steps to arrive at a finished telescoping product 170.

To aid in the automated manufacture of the telescoping embodiment 170 the stop flaps 22, 188, 198 should be dimensioned so that the stop flap 24 on the inner sliding piece 22 extends outward (upward as illustrated) from the inner sliding piece 22 a first distance X. The stop flaps 188 and 198 are cut out from their respective panels and extend outward (downward as illustrated) a distance X-1 and X-2, respectively. This successive reduction in stop flap sizes allows each stop flap to be folded in succession as the stacked components move through the assembly process.

The finger notches, 189, 199, and 209, are preferably offset to enable each sliding piece to be pulled out and locked in succession, but they can be pulled out in any order or even simultaneously, if desired.

Figure 17A:
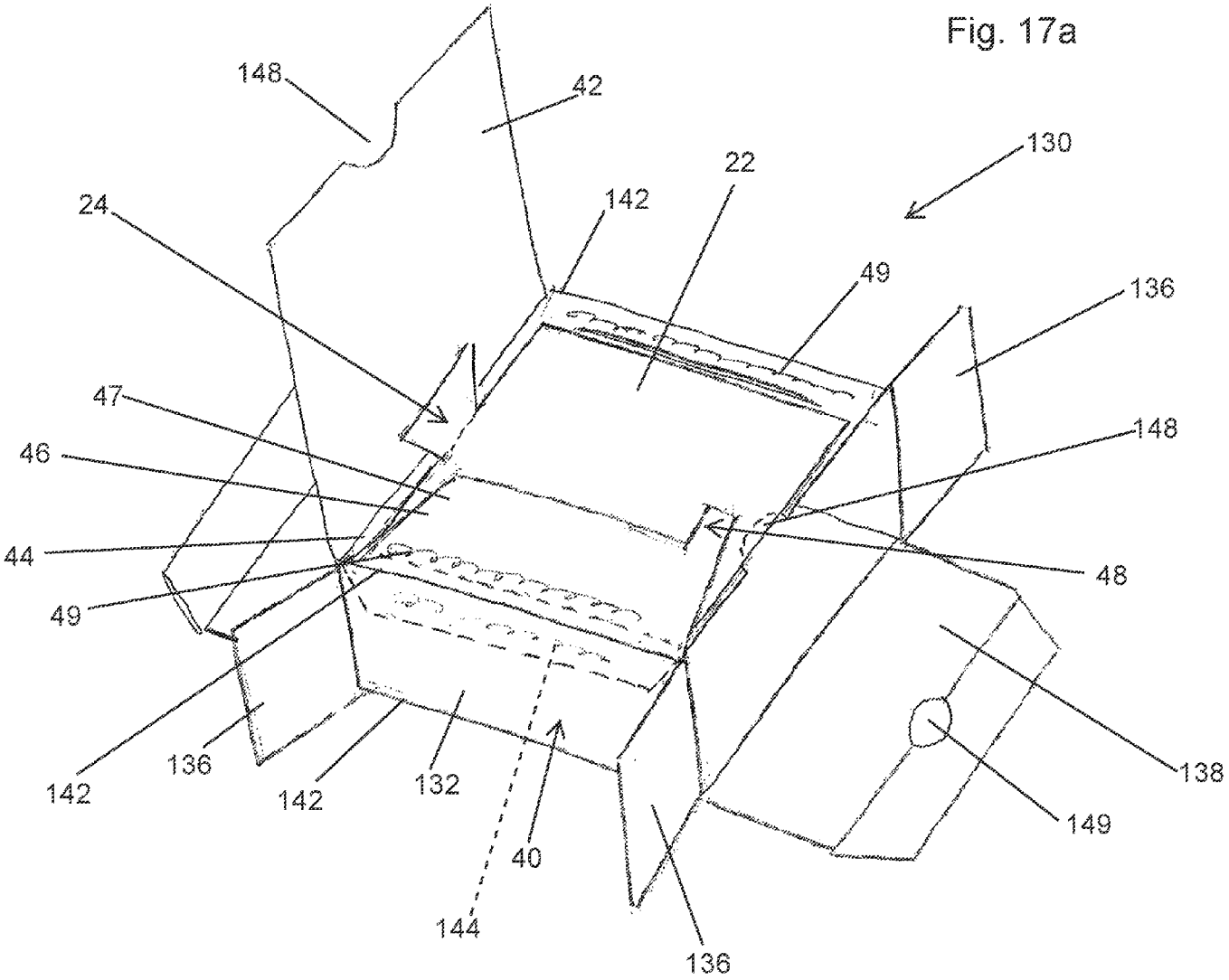
FIG. 17*a* is a perspective view of a box-shaped embodiment of the present invention.

FIG. 17*a* illustrates a box embodiment 130 of the present invention having an inner sliding piece 22 disposed on an outer sleeve in the three-dimensional form of a box 40. The outer sleeve 40 includes a top panel 42, a bottom panel 44, and side walls 132. In this embodiment, the inner sliding piece 22 is essentially flat and can be made of one or more layers of flat stock.

In this embodiment 130, there is only one slide flap 46 and stop panel 48 depicted. As with all of the embodiments described herein, only one slide flap 46 and one stop panel 48 are needed, but two can be provided, as described below for the embodiment depicted in FIGS. 17*b* through 17*d*.

The outer sleeve 40 in this embodiment also includes box flaps 136 at the ends of the outer sleeve 40, closing flap 138*a* and 138*b*, at the right and left of the illustrated embodiment, respectively. Preferably, the outer sleeve 40 is folded flat during assembly with the inner sliding piece 22 and opened by bending the corners 142 that can be scored for accurate folding. A glue flap 144 is also preferably included to aid in forming the box shape. Finger notches 148 and a hole 149 are provided for enabling the inner sliding piece 22 to be grasped and pulled.

Figure 17C:
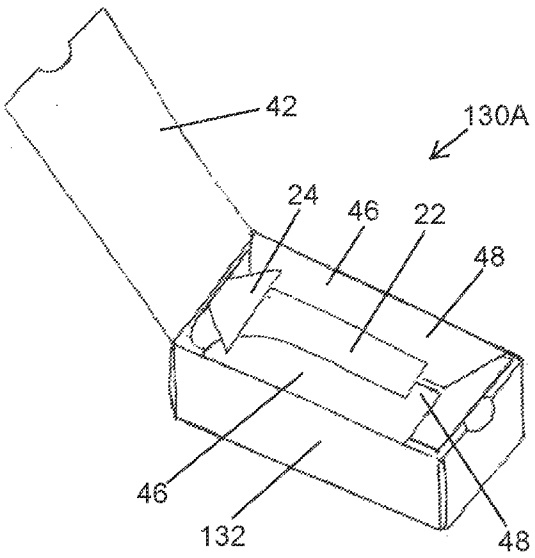
FIG. 17*c* is a perspective view of the embodiment of FIG. 17*b*, partially assembled.
Figure 17B:
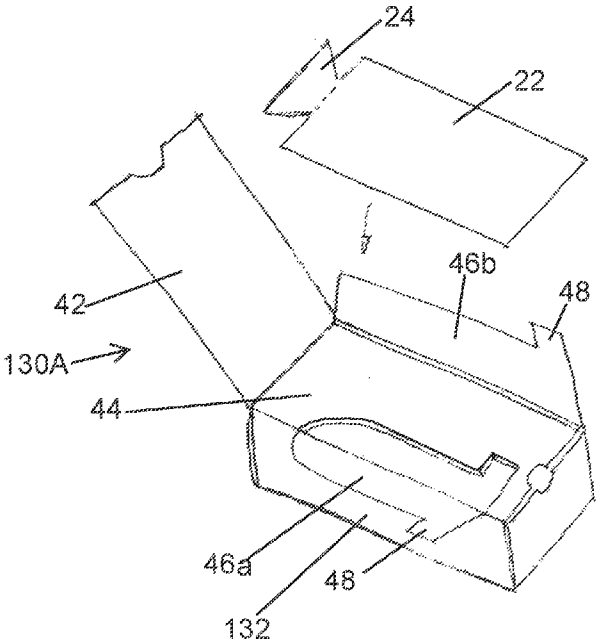
FIG. 17*b* is a perspective view of a second box-shaped embodiment of the present invention, partially assembled.
Figure 17D:
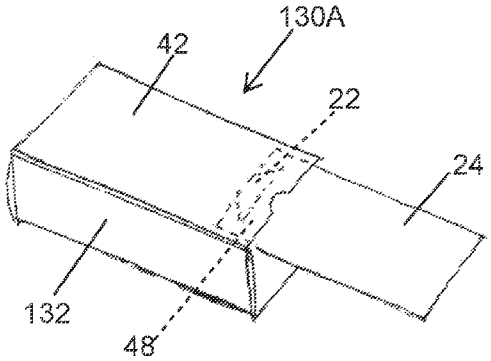
FIG. 17*d* is a perspective view of the embodiment of FIG. 17*b*, partially assembled.

The second box-shaped embodiment 130A is depicted in FIGS. 17*b* through 17*d*, and is similar to the embodiment of FIG. 17*a*, except that it includes two slide flaps of slightly different shapes, so they are identified as 46*a* and 46*b*. As seen in FIG. 17*b*, slide flap 46*a* is formed from a portion of the front panel 44 by die-cutting, for example, and then folded outward above the front panel 44 so that the inner sliding piece 22 can be assembled in the outer box-shaped sliding sleeve.

The other slide flap 46*b* could be formed the same way as the slide flap 46*a*, but instead, in this embodiment 130A, it is an extension of the box side panel (on the unseen side of the box). FIGS. 17*c* and 17*d* show the assembled box 130A in the sliding position (FIG. 17*c*) and the stop position (FIG. 17*d*).

Figure 18B:
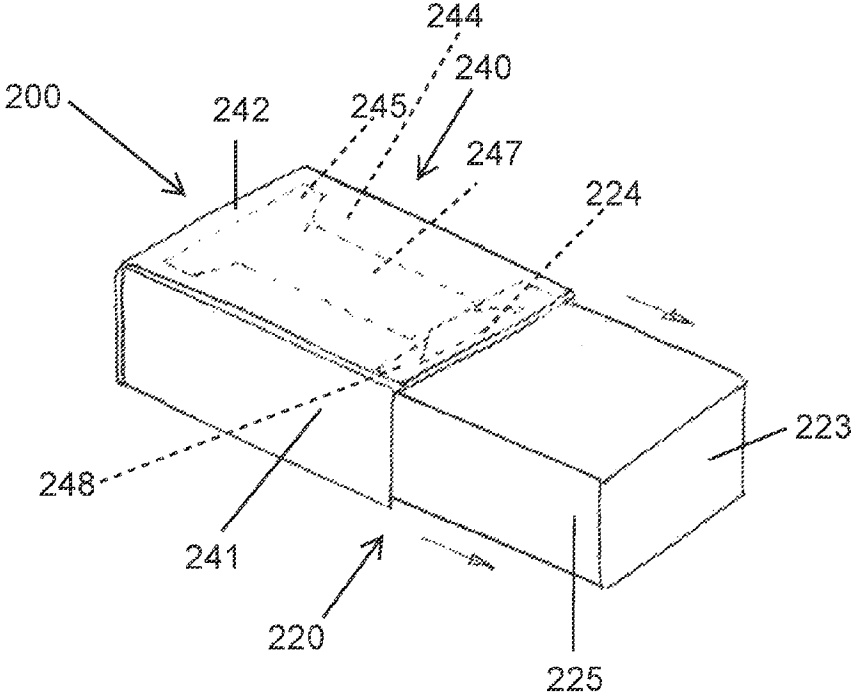
FIG. 18*b* is the package of FIG. 18*a* in a completed form.
Figure 18A:
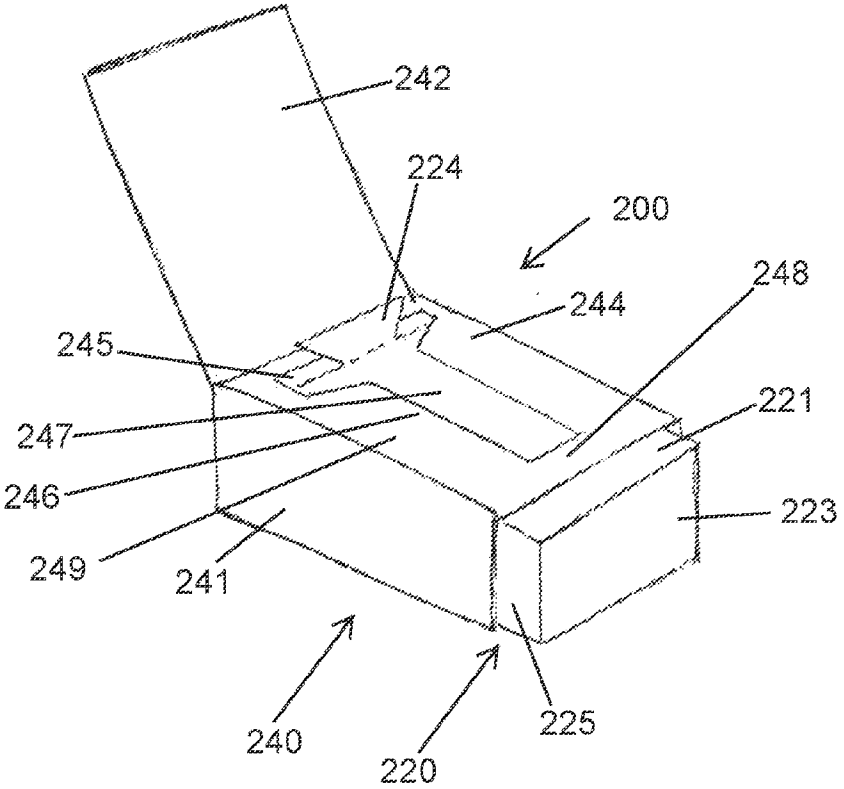
FIG. 18*a* is a perspective view of a package in accordance with the present invention in box form.

FIGS. 18*a* and 18*b* illustrate a box package 200 in which the inner sliding piece 220 is a box that can have an open or closed top 221, a closed end 223, and sides 225. Opposite the end 223, another end is also provided (not visible in the drawings). The ends 223 can be closed or open, and if closed, they can be permanently closed, or preferably, they can be "tuck flaps" that bend about a corner score line and have a tuck flap that slides under the top 221, for example. The inner sliding piece 220 also includes a stop tab 224.

The outer sleeve 240 is also in the shape of a box and includes side walls 241, a top panel 242, and a panel 244. The panel 244 defines an upper open area 245 and a slide slot 247. On opposite sides of the slide slot 247, are slide surfaces 246 and optional glue portions 249, that function as described above to provide a slide location for the tab 224 and to secure the top panel 242. A stop panel 248 is also provided to engage the stop tab 224 in a stop position.

In this embodiment 200, the upper open area 245 and the slide slot 247 are preferably die cut from the panel 244 so that the stop panel 248 remains at the bottom of the slot 247 and need not be formed or die cut separately. This arrangement can simplify assembly and provide a reliable construction.

If the inner sliding piece 220 is a box with an open top 221, the stop flap 224 can be formed integrally with the inner box or be attached. Preferably, the stop 224 is joined to the end of the box, a cross panel, or some other support for reinforcement.

A prior art embodiment 155 is shown in FIGS. 19 *a, b, c*, and *d*. In the prior art, the outer sleeve 140 is produced with a stop panel 158 which is shown folded over in FIG. 19*a*. An inner sliding piece 122 is produced with a stop panel 152 shown folded over in FIG. 19*b*. In assembly, the outer sleeve 140 is formed by folding the glue flaps 157 inward from the sides and folding the stop panel 158 up from the bottom. The top panel 142 is then folded over and glued to the glue flaps 157, but the glue flaps 157 do not engage or guide the inner sliding piece 122 because they do not extend inward far enough, they are on the opposite side of the inner sliding piece 122 from the stop flap 152, and they only serve to glue the panels together. The inner sliding piece 122 then first has a gift card 60 glued to it if desired, then the stop flap 152 is folded over the back, so there is no interaction with the glue flap 157. The assembled inner sliding piece 122 is then inserted into the outer sleeve 140, usually by hand.

Figure 19E:
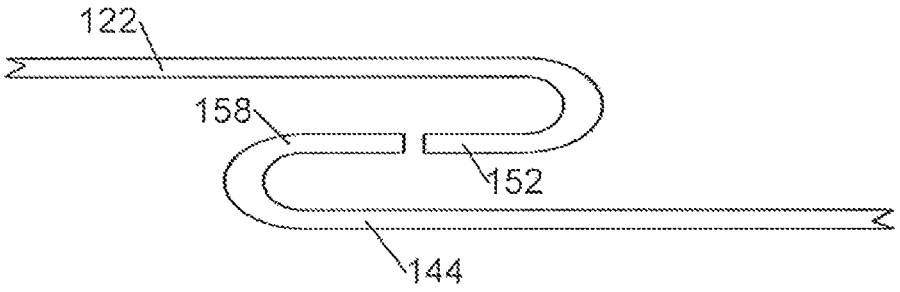
FIG. 19*e* is a cross-section of a prior art locking mechanism of the package in FIG. 19*c*.
Figure 19F:
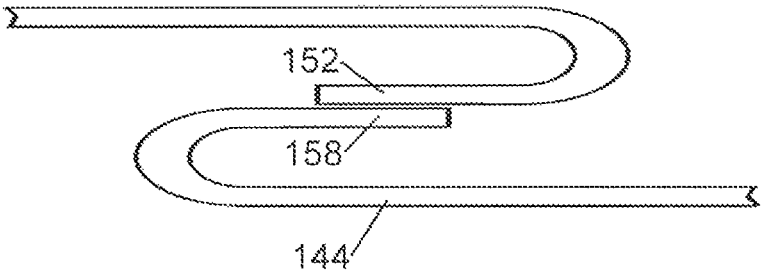
FIG. 19*f* is a cross-section of a prior art locking mechanism of the package in FIG. 19*c*.

FIG. 19*d* shows how the stop flap 152 of the inner sliding piece 122 is supposed to interlock with the stop panel 158 when the inner sliding piece 122 is pulled from the outer sleeve 140, but as seen in FIGS. 19*e* and 19*f*, the prior products have an outer sleeve 140 produced with an internal stop panel 158 folded up from the bottom of the sleeve 140 and extending all the way across the inside of the outer sleeve 140. An inner sliding piece 122 is produced with an extension of the sliding piece that is a stop flap 152 that is folded under the inner sliding piece and directed downward. As stated above, there is no interaction between stop flap 152 and the glue flap 157.

In assembly, the outer sleeve 140 is folded to have front 142 and back panels 144 that are secured to each other along the sides with glue on glue flaps 157 to form a pocket with an open bottom edge. The downwardly folded stop flap 152 at the top of the inner sliding piece 122 is intended to "hook" or interlock with the upwardly folded stop panel 158 at the bottom of the outer sleeve 140 when the inner sliding piece 122 is pulled part way out of the outer sleeve 140. This design, however, is unreliable because the downwardly folded stop flap 152 and upwardly folded stop panel 158 can engage each other at their leading edges as seen in FIG. 19*e* to prevent full extension of the inner piece 122 or they can fail to engage at all, slip past each other, and the inner piece can be pulled all the way out of the outer sleeve as seen in FIG. 19*f*. Thus, the prior designs are difficult and expensive to manufacture, and unreliable in operation.

The foregoing detailed description of the drawings is provided for clearness of understanding the invention only and no unnecessary limitations therefrom should be read into the following claims.

The invention claimed is:

1. A package comprising:

an outer sleeve having a first panel, a slide flap joined to and extending at least partially over the first panel and the slide flap includes a slide portion, a second panel joined to the first panel to define an internal space, and a stop panel joined to the slide flap and extending at least partially across the internal space; and an inner sliding piece disposed at least partially between the first panel and the slide flap for movement between a closed position and an extended position, the inner sliding piece including a stop flap extending at least partially over the inner sliding piece and slidably disposed at least partially between the slide flap slide portion and the second panel when the inner sliding piece is between the closed position and the extended position, and the stop flap is at least partially disposed between the stop panel and the second panel of the outer sleeve when the inner sliding piece is in the extended position.

2. The package of claim 1, and further comprising:

a removable security device joined to the outer sleeve to restrict access to the inner sliding piece.

3. The package of claim 2, wherein the removable security device comprises:

a security tab.

4. The package of claim 2, and further comprising:

a second removable security device joined to the outer sleeve to restrict access to the inner sliding piece.

5. The package of claim 2, and further comprising:

a second outer sleeve at least partially surrounding the inner sliding piece; and a second removable security device joined to the second outer sleeve to restrict access to the inner sliding piece.

6. The package of claim 1, wherein the first panel is joined integrally with and folded at least partially over the second panel.

7. The package of claim 1, wherein the first panel and the second panel are substantially the same size.

8. The package of claim 1, wherein the outer sleeve is opened at a lower end and the stop panel is disposed adjacent to the open lower end.

9. The package of claim 1, wherein the outer sleeve stop panel extends laterally across the internal space.

10. The package of claim 1, wherein the slide flap further includes a glue portion.

11. The package of claim 1, wherein the slide flap slide portion is disposed adjacent to an inner edge of the slide flap.

12. The package of claim 1, wherein the slide flap slide portion includes an edge against which a portion of the inner sliding piece is disposed for sliding movement.

13. The package of claim 1, wherein the inner sliding piece includes a central card-supporting portion.

14. The package of claim 1, wherein the inner sliding piece stop flap includes a portion that is at least partially disposed between the slide flap and the second panel of the outer sleeve.

15. The package of claim 1, and further comprising:

a second outer sleeve having a first panel, a slide flap joined to and folded at least partially over the first panel, a second panel joined to the first panel, and a stop panel extending transversely at least partially across an internal space defined by the first panel and the second panel; and the sliding piece further comprises a second stop flap extending at least partially over the inner sliding piece and the slide flap of the second outer sleeve and is disposed at least partially between the slide flap and the second panel of the second outer sleeve for sliding movement.

16. The package of claim 1, and the outer sleeve further comprises:

a second slide flap spaced apart from the slide flap, and the second slide flap is joined to and extends at least partially over the first panel and having a slide portion on which the inner slide piece stop flap is engaged.

17. The package of claim 1, wherein the outer sleeve includes a second stop panel spaced apart from the first stop panel and the stop flap, of the inner sliding piece is disposed between the stop panel and the second stop panel.

18. The package of claim 1, and further comprising:

a first telescoping sleeve having a first panel, a slide flap joined to and extending at least partially over the first panel, a second panel joined to the first panel, and a stop panel extending at least partially across an internal space defined by the first panel and the second panel; and the outer sleeve is slidably disposed at least partially in the first telescoping sleeve and the outer sleeve further includes a stop flap disposed at least partially between the second panel and the slide flap of the first telescoping sleeve.

19. The package of claim 18, and further comprising:

a second telescoping sleeve having a first panel, a slide flap joined to and extending at least partially over the first panel, a second panel joined to the first panel, and a stop panel extending at least partially across an internal space defined by the first panel and the second panel; and the first telescoping sleeve is slidably disposed at least partially in the second telescoping sleeve and the first telescoping sleeve further includes a stop flap disposed at least partially between the second panel and the slide flap of the second telescoping sleeve.

* * * * *